US009502831B2

(12) United States Patent
Seo et al.

(10) Patent No.: US 9,502,831 B2
(45) Date of Patent: Nov. 22, 2016

(54) ELECTRONIC DEVICE

(71) Applicant: Samsung Electronics Co., Ltd., Suwon-si, Gyeonggi-do (KR)

(72) Inventors: Hyun-Min Seo, Seoul (KR); Yong-Yi Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/640,742

(22) Filed: Mar. 6, 2015

(65) Prior Publication Data

US 2015/0288113 A1 Oct. 8, 2015

(30) Foreign Application Priority Data

Apr. 4, 2014 (KR) ..... 10-2014-0040656

(51) Int. Cl.
*H01R 13/703* (2006.01)
*H01R 12/71* (2011.01)
*H01R 103/00* (2006.01)

(52) U.S. Cl.
CPC ..... *H01R 13/7039* (2013.01); *H01R 13/703* (2013.01); *H01R 13/7031* (2013.01); *H01R 12/716* (2013.01); *H01R 2103/00* (2013.01)

(58) Field of Classification Search
CPC .. H01R 13/641; H01R 13/70; H01R 13/703; H01R 13/713; H01R 13/7031; H01R 13/7039; H01R 12/716; H01R 12/7094; H01R 24/46; H01R 2103/00; Y10S 439/944
USPC ..... 439/78, 188, 944; 200/51.1, 51.12, 200/51.09
See application file for complete search history.

(56) References Cited

U.S. PATENT DOCUMENTS 5,625,177 A * 4/1997 Yukinori ..... G01R 1/206 200/1 R
6,074,217 A * 6/2000 Maruyama ..... H01R 24/40 439/581
6,296,492 B1 * 10/2001 Fujimoto ..... H01R 13/6315 439/188
6,439,906 B1 * 8/2002 Gray ..... H01R 24/46 439/188
6,473,045 B1 * 10/2002 Duquerroy ..... H01Q 1/243 343/702
6,585,532 B2 * 7/2003 Uratani ..... H01R 24/46 200/51.1
8,226,426 B2 * 7/2012 Wang ..... H01R 9/05 324/750.25
8,309,868 B2 * 11/2012 Tuin ..... H01R 24/46 200/51.1

FOREIGN PATENT DOCUMENTS

KR 10-1268546 B1 5/2013

* cited by examiner

*Primary Examiner* — Neil Abrams
*Assistant Examiner* — Travis Chambers
(74) *Attorney, Agent, or Firm* — Jefferson IP Law, LLP

(57) ABSTRACT

An electronic device is provided. The electronic device includes a connection member mounted on a circuit board and a first connector coupled to the connection member, in which a signal terminal of the first connector is electrically connected to the circuit board through the connection member, and a ground terminal of the first connector is connected to a ground of the circuit board. The electronic device may be implemented variously.

19 Claims, 11 Drawing Sheets

ELECTRONIC DEVICE

CROSS-REFERENCE TO RELATED APPLICATION(S)

This application claims the benefit under 35 U.S.C. §119 (a) of a Korean patent application filed on Apr. 4, 2014 in the Korean Intellectual Property Office and assigned Serial number 10-2014-0040656, the entire disclosure of which is hereby incorporated by reference.

TECHNICAL FIELD

The present disclosure relates to an electronic device.

BACKGROUND

An electronic device refers to a device that performs a particular function, for example, outputs stored information as audio or video, according to an embedded program. The electronic device may be embodied as an electronic appliance, an electronic note, a portable multimedia player, a mobile communication terminal, a tablet Personal Computer (PC), a video/audio device, a desktop/laptop computer, a vehicle navigation system, or the like.

As the integration of an electronic device has increased and high-volume and ultra-high-speed wireless communication has come into common use, various functions are able to be mounted on a single mobile communication terminal. For example, an initial mobile communication terminal performs a limited communication function such as voice communication and short message transmission, but a recent mobile communication terminal, which has been smaller and lighter than the related art terminal, may implement, in a single electronic device, various functions, such as a communication function, an entertainment function such as a game, a multimedia function for playback of music/video, communication, security functions for mobile banking, and a function for schedule management or an electronic wallet. These various functions may be implemented based on ultra-high-speed and high capacity wireless communication such as real-time online games, video streaming, and the like.

An electronic device includes input devices such as a camera module, a keypad, a microphone, and the like, and output devices such as a display module, a speaker phone, and the like, and performs various functions under control of the controller provided on a circuit board. The electronic device may communicate with a service provider or another electronic device by using a communication module included therein. The input/output devices or communication module mounted on the electronic device are connected to the controller in a wireless/wired manner to transmit or receive various data.

With the popularization of ultra-high-speed and high capacity services through electronic devices, the electronic device may need therein a structure capable of transmitting and receiving large-volume data at high speed without data loss.

In the electronic device, a connection structure for connecting components such as the input/output devices or an antenna device to the communication module or a controller-side signal wire may cause a loss of a transmission signal. Thus, to mitigate transmission signal loss in the connection structure, additional circuits for providing impedance matching may be disposed in the electronic device.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device having a connection structure in which data can be transmitted and received fast between circuit devices while mitigating loss.

Another aspect of the present disclosure is to provide an electronic device in which the number of circuits for impedance matching is reduced by simplifying a connection structure between circuit devices, thereby improving the degree of freedom of design.

Another aspect of the present disclosure is to provide an electronic device having a connection structure that makes it easy to measure and correct radiation characteristics of a communication module if a wireless communication function is provided in the electronic device.

Other aspects to be provided in the present disclosure may be understood by various embodiments described below.

In accordance with an aspect of the present disclosure, an electronic device is provided. The electronic device includes a connection member mounted on a circuit board and a first connector coupled to the connection member, in which a signal terminal of the first connector is electrically connected to the circuit board through the connection member, and a ground terminal of the first connector is connected to a ground of the circuit board.

The electric connection between the signal terminal and the circuit board may be open by a second connector coupled to the first connector in a state where the first connector is coupled to the connection member.

The connection member may include a coupling portion fixed to the circuit board and a switch portion that is connected to the signal line of the circuit board and selectively connected with the coupling portion, and the first connector may include a signal terminal coupled to enclose the coupling portion and a ground terminal formed to surround the signal terminal, and the first connector may be coupled to the connection member to form a coaxial connector.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of a certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
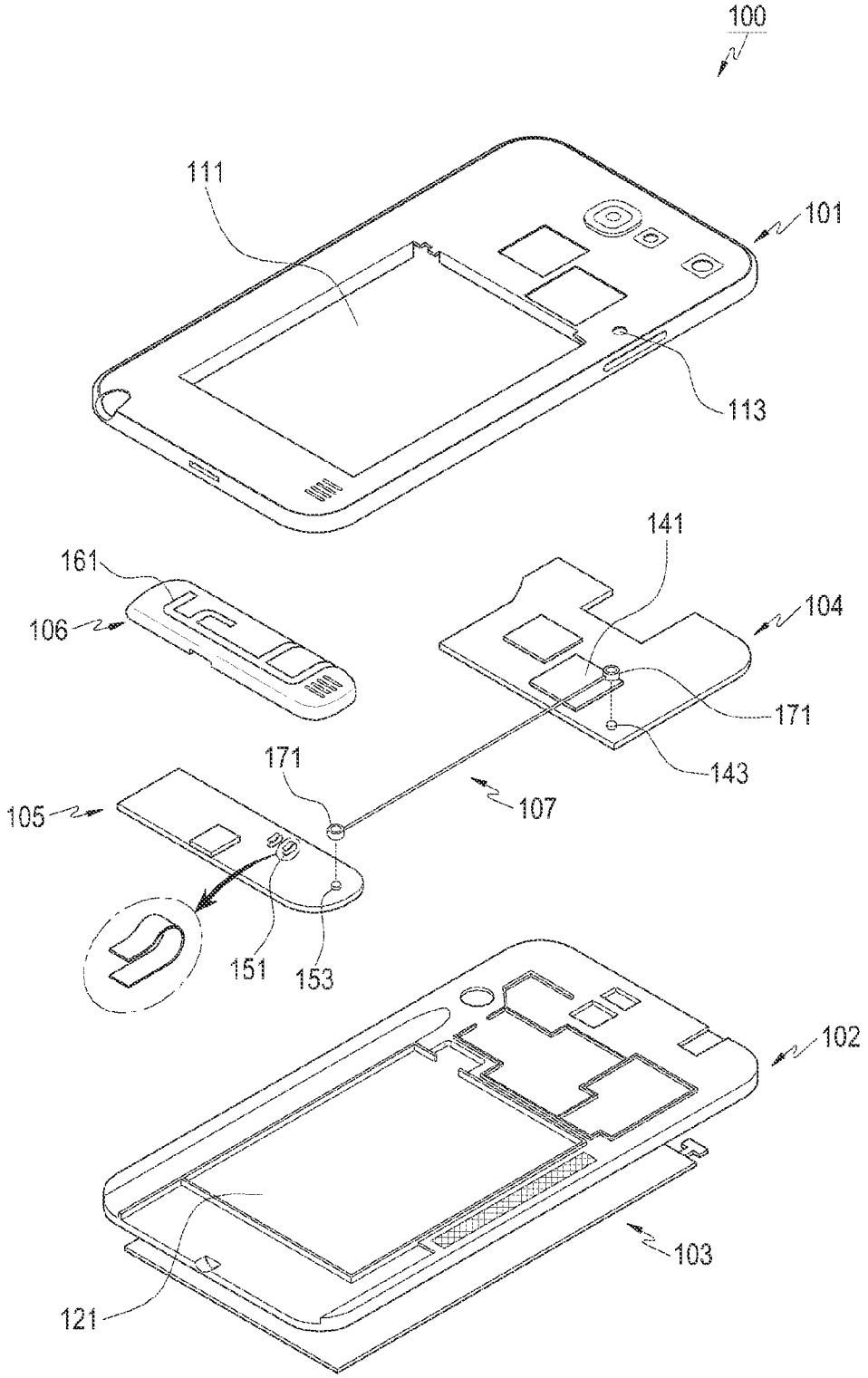
FIG. 1 is a perspective view of an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Although ordinal numbers such as "first", "second", and so forth will be used to describe various components of the present disclosure, those components are not limited by the terms. The terms are used only for distinguishing one component from another component. For example, a first component may be referred to as a second component and likewise, a second component may also be referred to as a first component, without departing from the teaching of the inventive concept. The term "and/or" used herein includes any and all combinations of one or more of the associated listed items.

Relative terms used based on illustration in the drawings, such as a "front side", a "rear side", a "top surface", a "bottom surface", and the like, may be replaced with ordinal numbers such as "first", "second", and the like. The order of the ordinal numbers such as "first", "second", and the like is a mentioned order or an arbitrarily set order, and may be changed as needed.

The terminology used herein is for the purpose of describing an embodiment only and is not intended to be limiting of an embodiment. As used herein, the singular forms are intended to include the plural forms as well, unless the context clearly indicates otherwise. It will be further understood that the terms "comprises" and/or "has" when used in this specification, specify the presence of a stated feature, number, step, operation, component, element, or a combination thereof but do not preclude the presence or addition of one or more other features, numbers, steps, operations, components, elements, or combinations thereof.

Unless defined otherwise, all terms used herein have the same meanings as generally understood by those having ordinary knowledge in the technical field to which the present disclosure pertains. Terms generally used and defined in dictionaries should be interpreted as having meanings consistent with meanings construed in the context of the related art, and should not be interpreted as having ideal or excessively formal meanings unless defined explicitly in this application.

In various embodiments of the present disclosure, an electronic device may be an arbitrary device having a touch panel and may be referred to as a terminal, a portable terminal, a mobile terminal, a communication terminal, a portable communication terminal, a portable mobile terminal, a display, or the like.

For example, the electronic device may be a smart phone, a cellular phone, a navigation device, a game console, a TeleVision (TV), a vehicle head unit, a laptop computer, a tablet computer, a Personal Media Player (PMP), a Personal Digital Assistant (PDA), or the like. The electronic device may be implemented with a pocket-size portable communication terminal having a wireless communication function. The electronic device may be a flexible device or a flexible display.

The electronic device may communicate with an external electronic device such as a server or may work by cooperating with the external electronic device. For example, the electronic device may transmit an image captured by a camera and/or position information detected by a sensor unit to the server over a network. The network may be, but not limited to, a mobile or cellular communication network, a Local Area Network (LAN), a Wireless Local Area Network (WLAN), a Wide Area Network (WAN), Internet, or a Small Area Network (SAN).

According to various embodiments of the present disclosure, an electronic device includes a connection member mounted on a circuit board and a first connector coupled to the connection member, in which a signal terminal of the first connector is electrically connected to the circuit board through the connection member, and a ground terminal of the first connector is connected to a ground of the circuit board.

According to an embodiment, the first connector is coupled to the connection member to form a coaxial connector.

According to another embodiment, the electric connection between the signal terminal and the circuit board is open by a second connector coupled to the first connector in a state where the first connector is coupled to the connection member.

According to another embodiment, the connection member includes a switch portion configured to open and close the connection to the signal terminal, and the switch portion opens the electric connection between the signal terminal and the circuit board by the coupling of the second connector.

According to another embodiment, the connection member further includes a coupling portion that is connected to the signal terminal by being coupled to the first connector, and the switch portion is connected to a signal line of the circuit board and is selectively connected with the coupling portion.

According to another embodiment, the switch portion includes any one of a dome switch, a tact switch, and a contact plate elastically supported in the coupling portion.

According to another embodiment, the coupling portion is in a cylindrical shape that surrounds the switch portion.

According to another embodiment, the signal terminal is coupled to enclose the connection member, and the ground terminal is formed to surround the signal terminal.

According to another embodiment, the connection member includes a coupling portion fixed to the circuit board and coupled to the signal terminal and a switch portion connected to a signal line of the circuit board and selectively connected with the coupling portion, in which the switch portion opens and closes connection between the coupling portion and the signal line of the circuit board according to the coupling of the second connector.

According to another embodiment, the signal terminal is connected to the signal line of the circuit board via the coupling portion and the switch portion as the signal terminal is coupled to the coupling portion, and as the second connector is coupled to the first connector, a signal pin of the second connector separates the switch portion from the coupling portion by passing through the first connector.

According to another embodiment, the electronic device further includes a cable connected to the first connector, in which the second connector includes an avoidance groove that at least partially receives the cable when being coupled to the first connector.

According to another embodiment, as the second connector is coupled to the first connector, a ground terminal of the second connector is connected to the ground terminal of the first connector.

According to another embodiment, the electronic device further includes a communication module mounted on the circuit board, a signal line formed on the circuit board to connect the connection member to the communication module, a radiation member configured to transmit and receive a Radio Frequency (RF) signal, and a cable connected to the radiation member, in which the first connector is provided in an end portion of the cable.

According to another embodiment, the connection member includes a coupling portion fixed to the circuit board and a switch portion that is connected to the signal line of the circuit board and selectively connected with the coupling portion, and the first connector includes a signal terminal coupled to enclose the coupling portion and a ground terminal formed to surround the signal terminal, and the first connector is coupled to the connection member to form a coaxial connector.

According to another embodiment, as the second connector, which is coupled to the first connector coupled to the connection member, is connected to the switch portion, the switch portion is separated from the coupling portion.

FIG. 1 is a perspective view of an electronic device 100 according to an embodiment of the present disclosure.

If the electronic device 100 includes a plurality of circuit boards or includes a component disposed independently of circuit boards, such as a radiation member 161 of an antenna device 106, a line for connecting a circuit board with a circuit board or connecting a circuit board with a component may be disposed. The line may be implemented with a cable or a Flexible Printed Circuit Board (FPCB). In the current embodiment, a cable 107 is used to connect a first circuit board 104 in which a communication module 141 is installed to a second circuit board 105 connected with the radiation member 161 of the antenna device 106.

Referring to FIG. 1, the electronic device 100 may include a housing 101, a bracket 102, a display module 103, the circuit boards 104 and 105, the antenna device 106, and any other similar and/or suitable components.

The housing 101 provides a space for receiving the bracket 102 and electronic components including the display module 103. A front side of the housing 101 is open and a mounting portion 111 for mounting a battery is provided on a back side of the housing 101. An opening 113 is formed in a side of the mounting portion 111 to pass through the housing 101.

The bracket 102 is disposed in the housing 101 to reinforce rigidity or stiffness of the housing 101. The bracket 102 provides a shielding function for preventing interference between the electronic components disposed in the housing 101, and supports the display module 103. A portion of the bracket 102 is positioned to correspond to the mounting portion 111, thus providing a mounting surface 121.

The display module 103 outputs a screen and may also be used as an input device by having a touch panel integrated therein. The display module 103 is mounted on the front side of the housing 101 by being supported by the bracket 102.

At least one circuit board may be installed on the housing 101, and in the current embodiment, two circuit boards 104 and 105 are installed on the housing 101 as an example. On the first circuit board 104, the communication module 141 may be installed and circuit devices for performing the overall operation of the electronic device 100, such as a controller and a storage, may be mounted. On the second circuit board 104, a connection terminal 151 for connecting the antenna device 106, for example, a C-clip may be mounted.

The antenna device 106 may include a carrier, for example, on an outer circumferential surface of which the radiation member 161 is disposed. In the antenna device 106, an audio module, for example, a microphone or a speaker phone may be disposed. The radiation member 161 may be connected to the second circuit board 105 through the connection terminal 151. If the communication module 141 is mounted on the first circuit board 104, the radiation member 161 may be connected to the communication module 141 through the cable 107, for example, a coaxial cable.

To connect the radiation member 161 to the communication module 141 through the cable 107, connection members 143 and 153 may be disposed on the first and second circuit boards 104 and 105. On the cable 107, a first connector 171 coupled with the connection members 143 and 153 may be provided.

Figure 2:
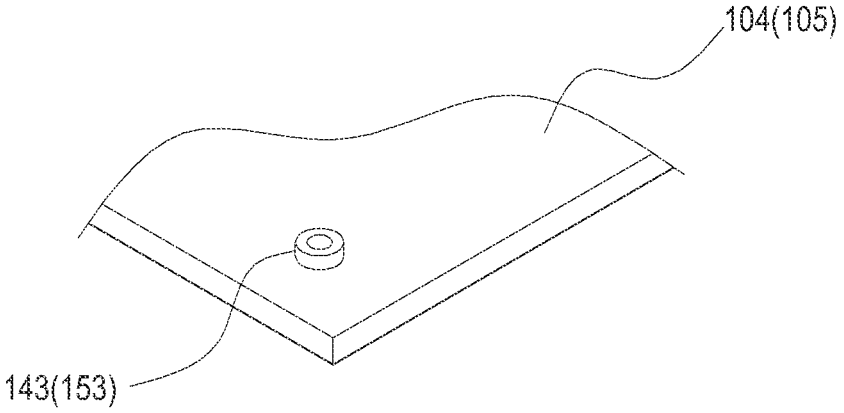
FIG. 2 is a perspective view of a connection member of an electronic device according to an embodiment of the present disclosure.
Figure 3:
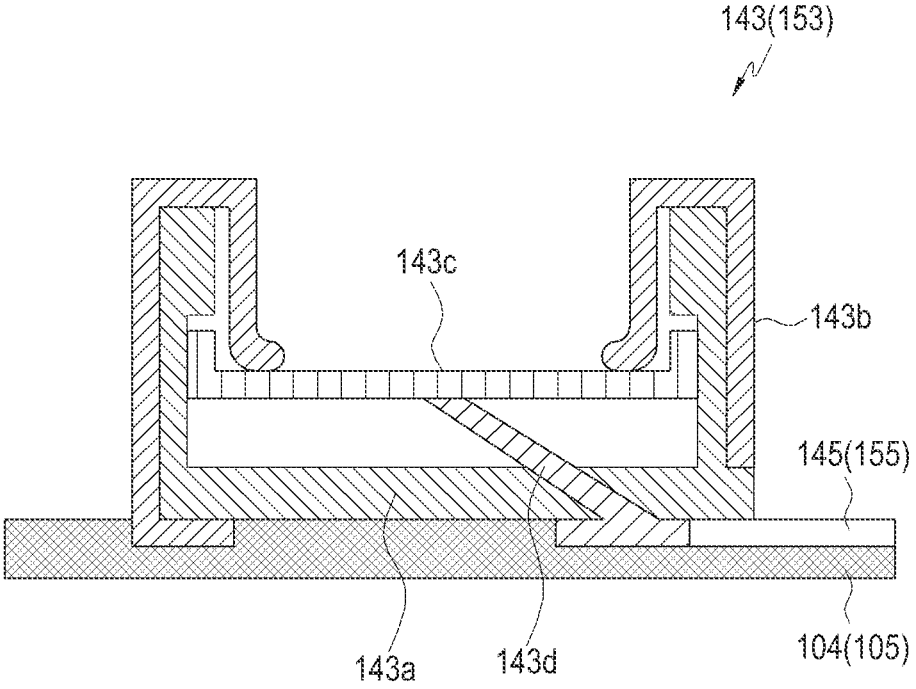
FIG. 3 is a cross-sectional view of a connection member of an electronic device according to an embodiment of the present disclosure.
Figure 4:
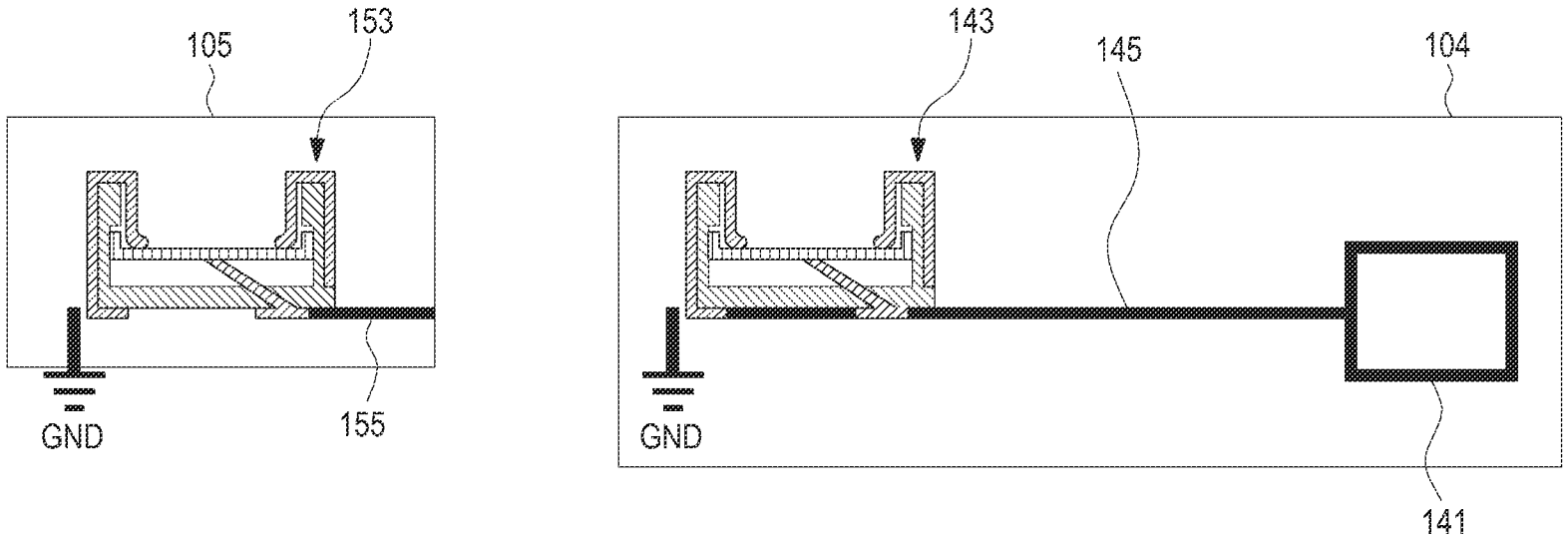
FIG. 4 illustrates disposition of circuit devices of an electronic device according to an embodiment of the present disclosure.

FIG. 2 is a perspective view of the connection member 143 or 153 of the electronic device 100 according to an embodiment of the present disclosure. FIG. 3 is a cross-sectional view of the connection member 143 or 153 of the electronic device 100 according to an embodiment of the present disclosure. FIG. 4 illustrates disposition of circuit devices of the electronic device 100 according to an embodiment of the present disclosure.

Referring to FIGS. 2, 3, and 4, the connection members 143 and 153 may include a coupling portion 143*a* and switch portions 143*c* and 143*d*. The connection members 143 and 153 may be provided on the first circuit board 104 and the second circuit board 105, respectively. In an embodiment, the connection members 143 and 153 may be provided on one of the first and second circuit boards 104 and 105, and the cable 107 may be connected to the other circuit board through soldering or a connection member in another form.

The coupling portion 143*a* is installed and fixed to the first circuit board 104 (for the second circuit board 105), and at least an outer circumferential surface of the coupling portion 143*a* is provided as a conductor 143*b*. In the current embodiment, for example, the conductor 143*b* is provided in a portion of the outer circumferential surface and an inner circumferential surface of the coupling portion 143*a*. The switch portions 143*c* and 143*d* are connected to signal lines 145 and 155 of the circuit boards 104 and 105. The switch portions 143*c* and 143*d* are connected with other circuit devices, for example, the communication module 141 through the signal lines 145 and 155.

The switch portions 143*c* and 143*d* may include a contact plate 143*c* installed in the coupling portion 143*a* in a way to be elevated or lowered and an elastic body 143*d* elastically supporting the contact plate 143*c*. The elastic body 143*d* provides an elastic force in a direction urging the contact plate 143*c* to contact the conductor 143*b* of the coupling portion 143*a*, and the elastic body 143*d* connects the contact plate 143*c* to the signal lines 145 and 155. For example, the switch portions 143*c* and 143*d* may open/close electric connection between the coupling portion 143*a* and the signal lines 145 and 155 according to elevation/lowering of the contact plate 143*c*.

Figure 5:
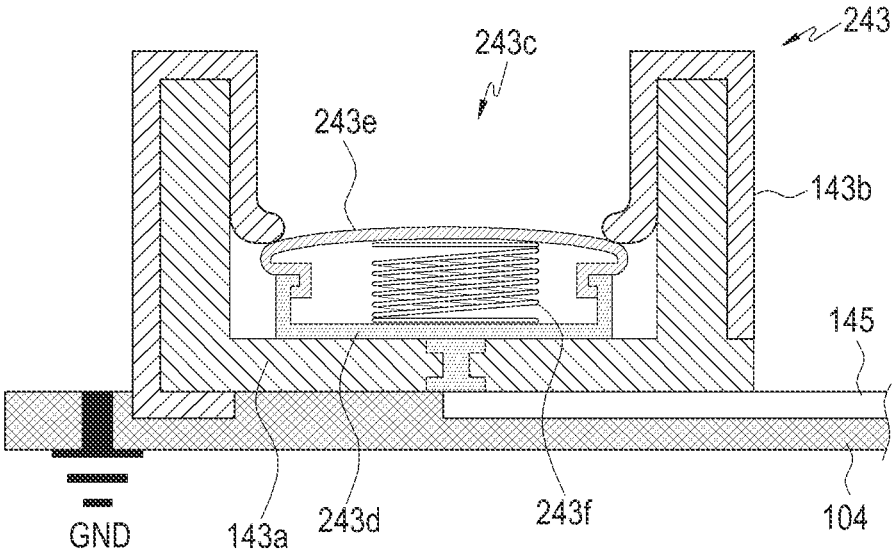
FIG. 5 illustrates another example of a connection member of an electronic device according to an embodiment of the present disclosure.
Figure 6:
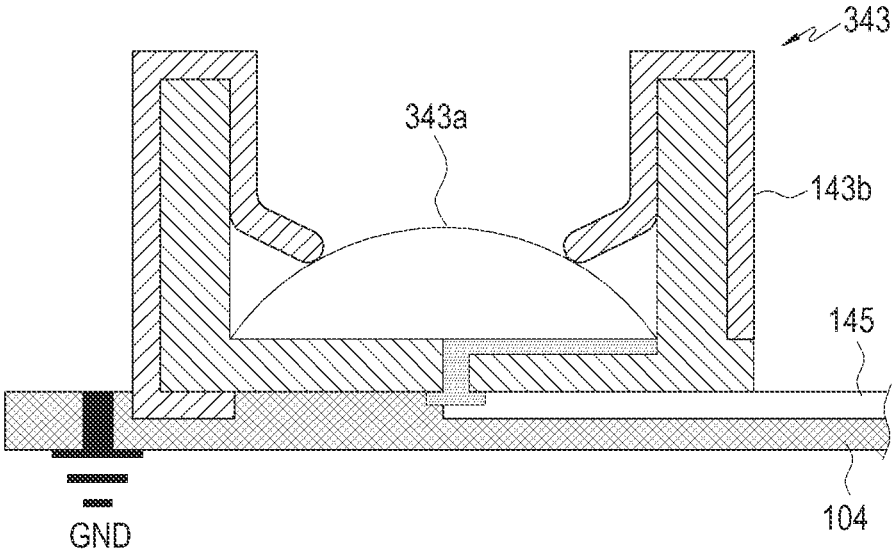
FIG. 6 illustrates another example of a connection member of an electronic device according to an embodiment of the present disclosure.
Figure 7:
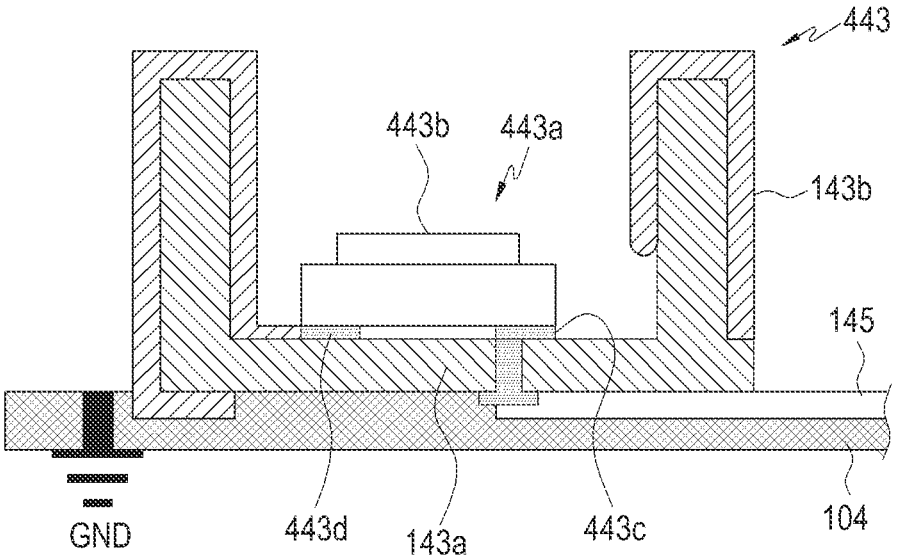
FIG. 7 illustrates another example of a connection member of an electronic device according to an embodiment of the present disclosure.

FIG. 5 illustrates another example of a connection member of the electronic device 100 according to an embodiment of the present disclosure. FIG. 6 illustrates another example of a connection member of the electronic device 100 according to an embodiment of the present disclosure. FIG. 7 illustrates another example of the electronic device 100 according to an embodiment of the present disclosure.

As illustrated in FIGS. 5, 6, and 7, the connection member may be implemented variously.

Referring to FIG. 5, a connection member 243 including a switch portion 243*c* implemented with a pogo pin structure is illustrated. For example, the switch portion 243*c* may couple a contact plate 243*e* to a body 243*d* receiving an elastic body 243*f*. The body 243*d*, the elastic body 243*f*, and the contact plate 243*e* may be manufactured with a conductive material, and the body 243*d* may be connected to the signal line 145. The contact plate 243*e* may be coupled to the body 243*d* in such a way to be elevated or lowered or to be contracted. The contact plate 243*e* maintains contact to the conductor 143*b* of the coupling portion 143*a* by means of the elastic body 243*f*, and may be separated from the conductor 143*b* by being lowered or contracted by an external force.

Referring to FIG. 6, a connection member 343 including a switch portion 343*a* implemented with a dome switch is illustrated. The switch portion 343*a* may be directly connected to the signal line 145 or may operate by an external force to selectively contact the conductor 143*b*.

Referring to FIG. 7, a connection member 443 including a switch portion 443*a* implemented with a tact switch structure is illustrated. An operating portion 443*b* of the switch portion 443*a* is electrically connected to a first terminal 443*c* connected to the signal line 145, and a second terminal 443*d* is connected to the conductor 143*b*. By operating by an external force, the operating portion 443*b* opens/closes connection between the coupling portion 143*a* and the signal line 145, for example, connection between the first terminal 443*c* and the second terminal 443*d*. For example, the tact switch 443*a* connects the coupling portion 143*a* with the signal line 145 when no external force is applied, and if an external force is applied, the tact switch 443*a* opens the connection between the coupling portion 143*a* and the signal line 145.

Figure 8:
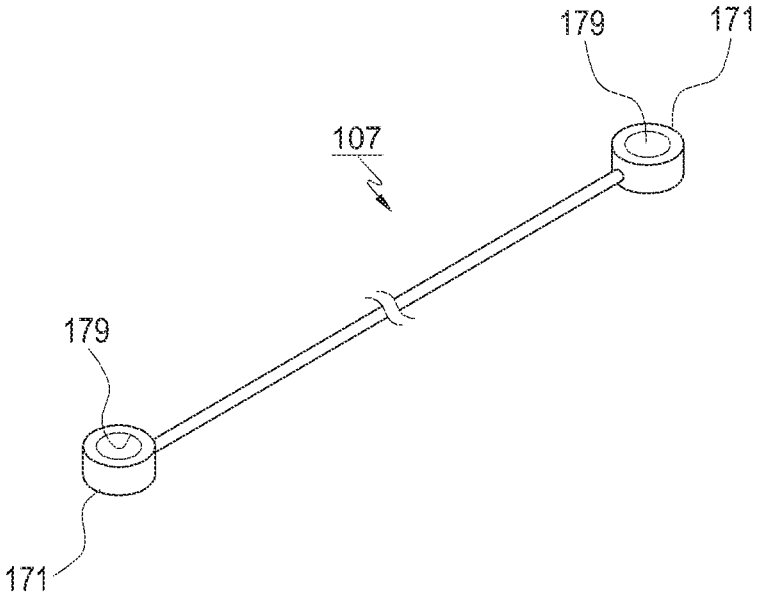
FIG. 8 illustrates a cable of an electronic device according to an embodiment of the present disclosure.
Figure 9:
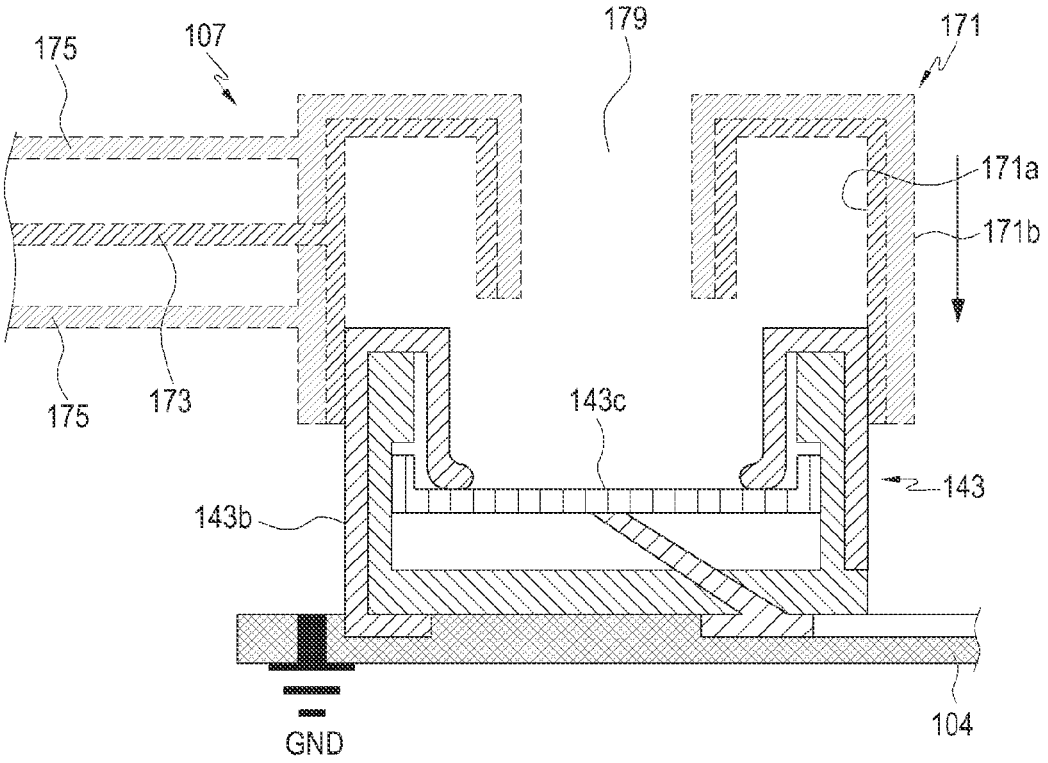
FIG. 9 illustrates a state in which a first connector of an electronic device according to an embodiment of the present disclosure is being coupled to a connection member.
Figure 10:
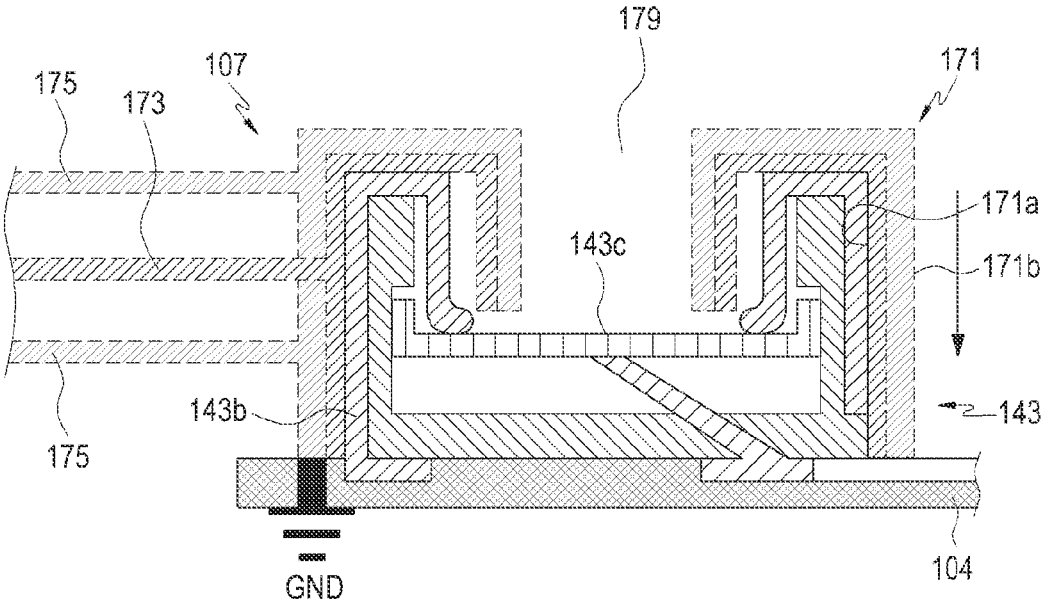
FIG. 10 illustrates a state in which a first connector of an electronic device according to an embodiment of the present disclosure has been coupled to a connection member.
Figure 11:
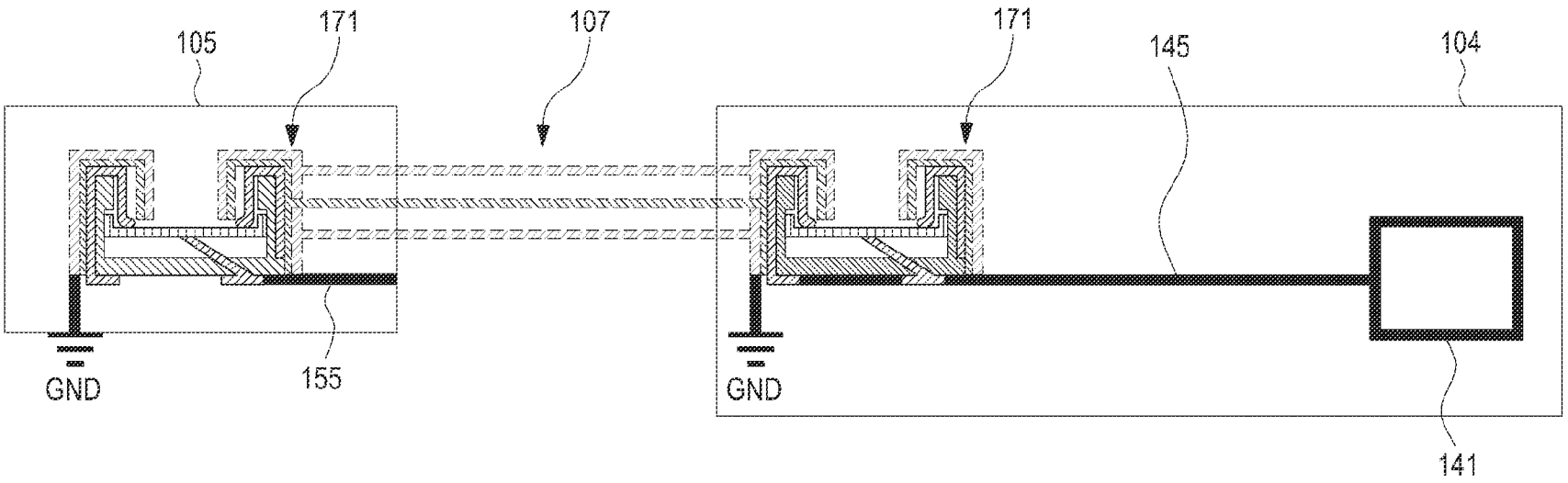
FIG. 11 illustrates a state in which a cable of an electronic device according to an embodiment of the present disclosure is coupled to circuit devices.

FIG. 8 illustrates the cable 107 of the electronic device according to an embodiment of the present disclosure. FIG. 9 illustrates a state in which the first connector 171 of the electronic device 100 according to an embodiment of the present disclosure is being coupled to the connection member 143 or 153. FIG. 10 illustrates a state in which the first connector 171 of the electronic device 100 according to an embodiment of the present disclosure has been coupled to the connection member. FIG. 11 illustrates a state in which the cable 107 of the electronic device 100 according to an embodiment of the present disclosure is coupled to circuit devices.

Referring to FIGS. 8 and 9, the cable 107 may be a coaxial cable including an inner conductor 173 and an outer conductor 175 surrounding the inner conductor 173. The surface of the inner conductor 173 and the outer conductor 175 may be wound with an insulator. The inner conductor 173 is connected to a signal terminal 171*a* of the first connector 171, and the outer conductor 175 is connected to a first ground terminal 171*b* of the first connector 171. An insulator may be interposed between the signal terminal 171*a* and the first ground terminal 171*b*. In the first connector 171, a connection hole 179 may be formed.

Referring to FIG. 10, the first connector 171 is coupled to the connection members 143 and 153. For example, the first connector 171 may be coupled such that the signal terminal 171*a* encloses the coupling portion 143*a*, thus being electrically connected with the conductor 143*b*. The first ground terminal 171*b* is formed to surround the signal terminal 171*a*, and once being coupled to the connection member 143, the first connector 171 is connected to a ground GND of the first circuit board 104 (or the second circuit board 105). In the first connector 171, a connection hole 179 may be formed. Through the connection hole 179, the switch portions 143*c* and 143*d* of the connection members 143 and 153, for example, the contact plate 143*c* may be exposed to the outside of the first connector 171. For example, the first connector 171 is coupled to the connection members 143 and 153 to form a coaxial connector. If the first connector 171 forms a coaxial connector by being coupled with the connection member 143 or 153, the coupling portion 143*a*, the signal terminal 171*a*, and the ground terminal 171*b* may have cylindrical shapes, respectively.

Referring to FIG. 11, the first circuit board 104 and the second circuit board 105 are electrically connected using the cable 107, and by being coupled to the connection members 143 and 153, the first connector 171 may form a new connector, for example, a coaxial connector.

Figure 12:
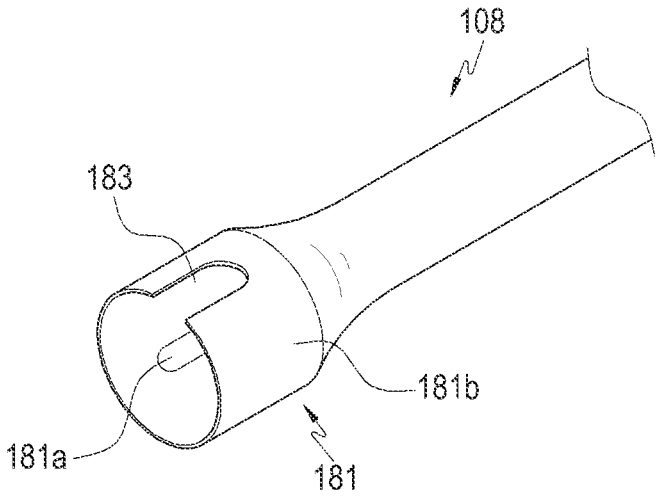
FIG. 12 illustrates a second connector to be coupled to an electronic device according to an embodiment of the present disclosure.
Figure 13:
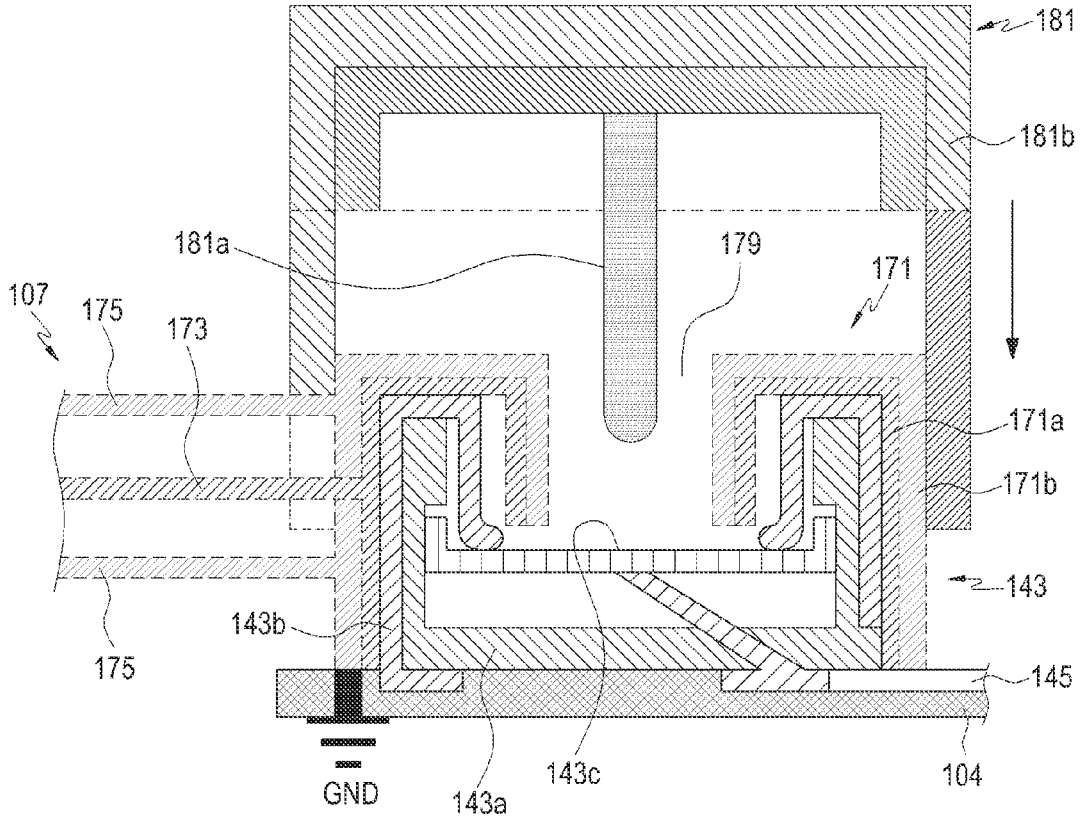
FIG. 13 illustrates a state in which a second connector is being coupled to a first connector of an electronic device according to an embodiment of the present disclosure.
Figure 14:
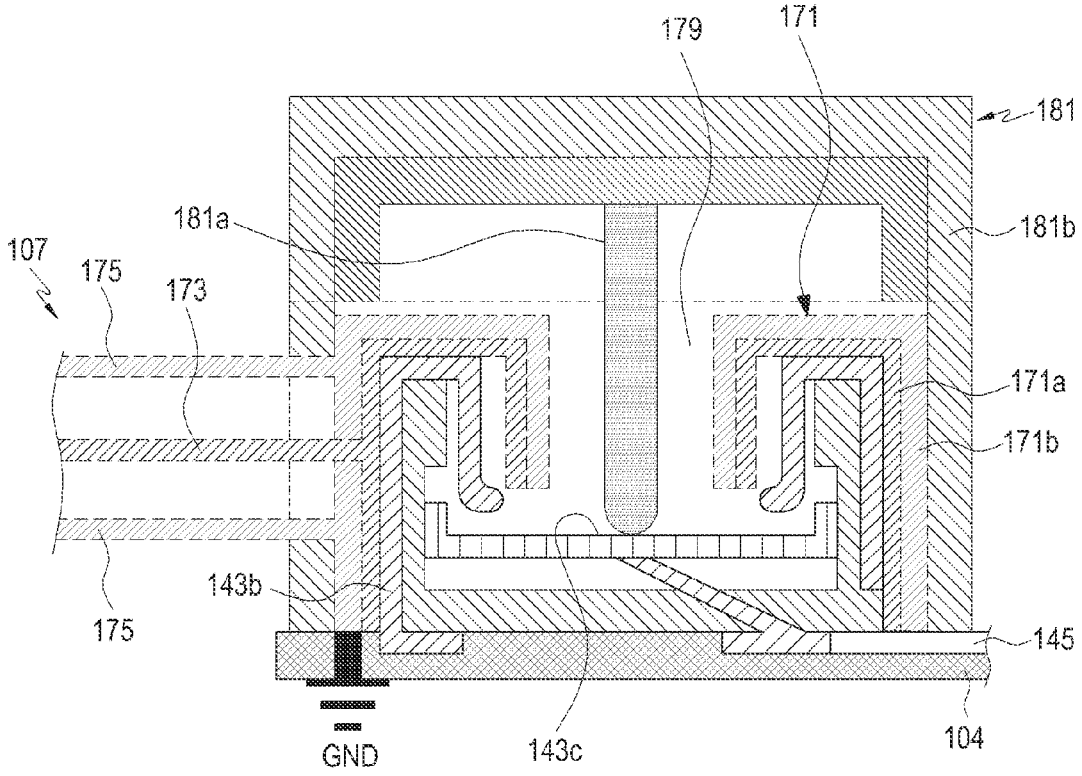
FIG. 14 illustrates a state in which a second connector has been coupled to a first connector of an electronic device according to an embodiment of the present disclosure.
Figure 15:
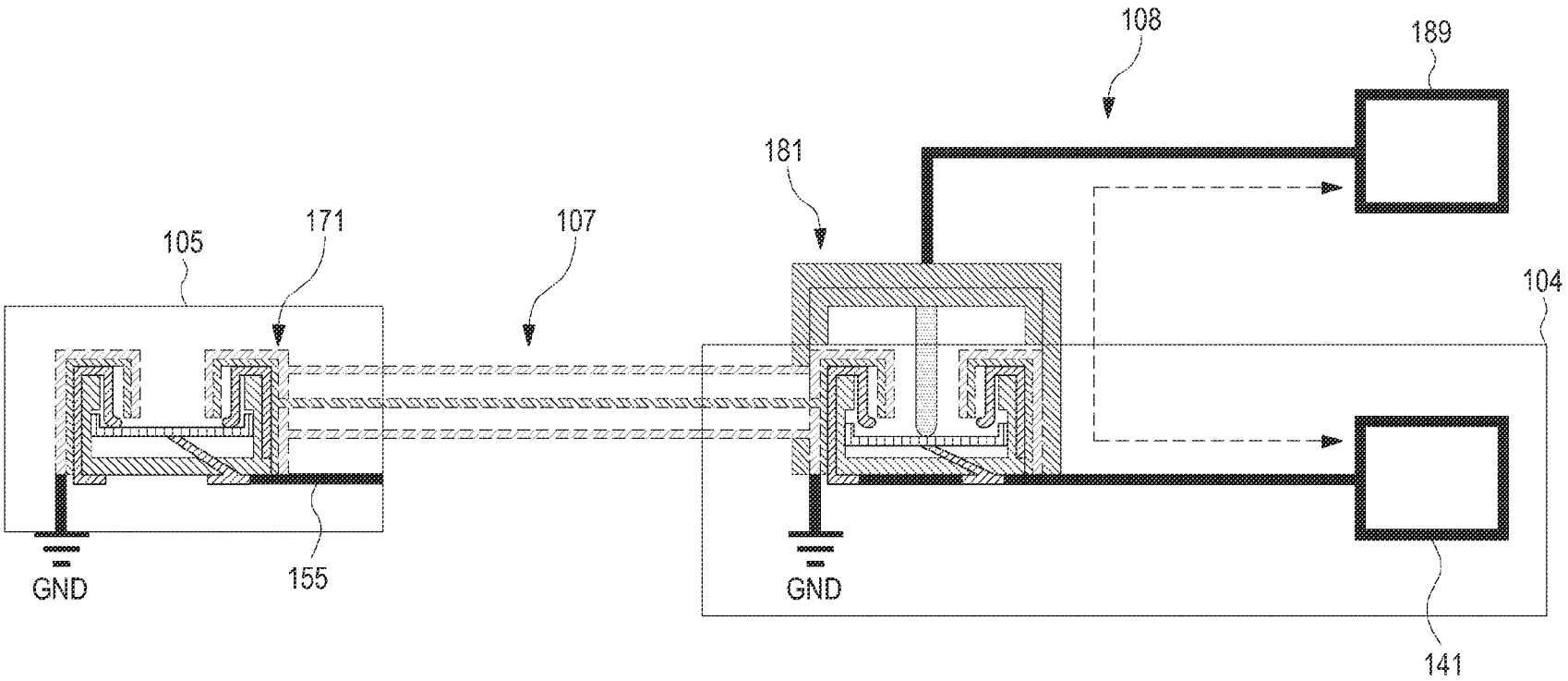
FIG. 15 illustrates a state in which a second connector has been coupled to an electronic device according to an embodiment of the present disclosure.

FIG. 12 illustrates a second connector 181 to be coupled to the electronic device 100 according to an embodiment of the present disclosure. FIG. 13 illustrates a state in which the second connector 181 is being coupled to the first connector 171 of the electronic device 100 according to an embodiment of the present disclosure. FIG. 14 illustrates a state in which the second connector 181 has been coupled to the first connector 171 of the electronic device 100 according to an embodiment of the present disclosure. FIG. 15 illustrates a state in which the second connector 181 has been coupled to the electronic device 100 according to an embodiment of the present disclosure.

Referring to FIGS. 12, 13, 14, and 15, through another connector, for example, a coaxial connector, which is formed by coupling of the first connector 171 to the connection members 143 and 153, the second connector 181 is connected to the electronic device 100. For example, if the first connector 171 and the connection members 143 and 153 are provided on a feed line, a wireless communication performance test device 189 can be connected to the electronic device 100 through a connector formed by coupling of the first connector 171 to the connection members 143 and 153. The wireless communication performance test device 189 measures if a Radio Frequency (RF) signal output from the communication module 141 is within an allowable error range after the electronic device 100 is assembled, and if necessary, the wireless communication performance test device 189 corrects an output of the communication module 141. The second connector 181 enters the housing 101 through the opening 113 formed in the housing 101.

The second connector 181 may include an avoidance groove 183 formed by removing at least a portion of a second ground terminal 181*b*. When the second connector 181 is coupled to the first connector 171, the avoidance groove 183 may receive at least a portion of the cable 107.

Referring to FIG. 12, the second connector 181 is provided in an end portion of a coaxial cable 108 extending from the wireless communication performance test device 189. The second connector 181 may include a signal pin 181*a* connected to an inner conductor of the coaxial cable 108 and the second ground terminal 181*b* connected to an outer conductor of the coaxial cable 108. The second ground terminal 181*b* is provided to surround the signal pin 181*a*, and as illustrated in FIG. 13, is coupled to enclose the first ground terminal 171*b*.

Referring to FIG. 14, if the second connector 181 is completely coupled to the connection member 143, the second ground terminal 181*b* may be connected to the ground GND of the first circuit board 104 through the first ground terminal 171*b*. When the second connector 181 is coupled to the first connector 171, the signal pin 181*a* enters the first connector 171 through the first connector 171, for example, the connection hole 179. The signal pin 181*a* entering the first connector 171 presses the switch portions 143*c* and 143*d*. As the signal pin 181*a* presses the switch portions 143*c* and 143*d*, the contact plate 143*c* is separated from the conductor 143*b*. For example, the switch portions 143*c* and 143*d* open connection between the radiation member 161 and the communication module 141.

When the second connector 181 is coupled to the connection member 143, the cable 107 is disposed in the avoidance groove 183. Thus, the second connector 181, for example, the second ground terminal 181*b* is coupled to the connection member 143 without being interfered by the cable 107. According to another embodiment, the avoidance groove 183 may be provided in plural. The number of avoidance grooves 183 is properly set based on the thickness of the cable 107 and the size and stiffness of the second connector 181.

Referring to FIG. 15, since the signal pin 181*a* is in contact with the contact plate 143*c*, the wireless communication performance test device 189 is connected to the electronic device 100, for example, the communication module 141. Thus, connection between the communication module 141 and the second circuit board 105 (or the radiation member 161) is open and the communication module 141 is connected to the wireless communication performance test device 189. As the second connector 181 is coupled to the connection member 143, the wireless communication performance test device 189 measures performance of the communication module 141, and if necessary, corrects an output of the communication module 141.

Generally, for connection to the wireless communication performance test device 189, the electronic device 100 may include separate connector and RF switch. This is intended to correct distortion of radiation characteristics, caused by manufacturing tolerance or assembly tolerance of components of the electronic device 100. The connector or the RF switch is not used for operations of the electronic device 100 and may cause connection loss in RF signal transmission for wireless communication. To mitigate a connection loss, an impedance matching circuit may be further disposed.

On the other hand, as mentioned previously, in the electronic device according to various embodiments of the present disclosure, a connection structure for connecting the circuit board with the radiation member may form a new connector, for example, a coaxial connector. Hence, the electronic device according to various embodiments of the present disclosure may provide a connector for connection of another electronic device, for example, a wireless communication performance test device without disposition of additional connector or RF switch. Since the additional connector or RF switch does not need to be disposed, a configuration of a circuit device, such as an impedance matching circuit may be simplified, such that the electronic device according to various embodiments of the present disclosure may improve the degree of freedom of design of the circuit board.

The electronic device according to various embodiments of the present disclosure may allow additional connection of another device, for example, a wireless communication performance test device to a transmission line without a need to install an additional connector. Thus, the electronic device according to various embodiments of the present disclosure does not need an additional connector or RF switch, thereby improving a connection loss and improving the degree of freedom of design of the circuit board. Moreover, by reducing the number of connection structures, for example, connectors, the impedance matching circuit may be simplified. Furthermore, when the radiation member of the antenna is connected with the communication module, the electronic device according to various embodiments of the present disclosure may form a new connection structure, for example, a coaxial connector by using coupling between the connection member of the circuit board and the first connector coupled to the connection member. Therefore, a connection loss between the radiation member and the communication module may be enhanced while providing the connection structure of the wireless communication performance test device.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a cable;

a connection member mounted on a circuit board; and a first connector provided in an end portion of the cable and coupled to the connection member, wherein a signal terminal of the first connector is electrically connected to the circuit board through the connection member, and a ground terminal of the first connector is connected to a ground of the circuit board, wherein the connection member comprises a switch portion connected to a signal line of the circuit board, and wherein, when the first connector is coupled to the connection member, a portion of the switch portion is exposed to the outside of the first connector to form a center conductor of a coaxial connector and the ground terminal forms a outer conductor of the coaxial connector.

2. The electronic device of claim 1, further comprising:

a communication module mounted on the circuit board; and a radiation member configured to transmit and receive a Radio Frequency (RF) signal, wherein the cable is connected to the radiation member and the signal line connects the connection member to the communication module.

3. The electronic device of claim 1, wherein the connection member comprises a coupling portion fixed to the circuit board and the switch portion selectively connected with the coupling portion.

4. An electronic device comprising:

a connection member mounted on a circuit board; and a first connector coupled to the connection member, wherein a signal terminal of the first connector is electrically connected to the circuit board through the connection member, and a ground terminal of the first connector is connected to a ground of the circuit board, and wherein the electric connection between the signal terminal and the circuit board is open by a second connector coupled to the first connector in a state where the first connector is coupled to the connection member.

5. The electronic device of claim 4, wherein the connection member comprises a switch portion configured to open and close the connection to the signal terminal, and the switch portion opens the electric connection between the signal terminal and the circuit board by the coupling of the second connector.

6. The electronic device of claim 5, wherein the connection member further comprises a coupling portion that is connected to the signal terminal by being coupled to the first connector, and the switch portion is connected to a signal line of the circuit board and is selectively connected with the coupling portion.

7. The electronic device of claim 6, wherein the switch portion comprises one of a dome switch, a tact switch, and a contact plate elastically supported in the coupling portion.

8. The electronic device of claim 6, wherein the coupling portion is in a cylindrical shape that surrounds the switch portion.

9. The electronic device of claim 4, wherein the signal terminal is coupled to enclose the connection member, and the ground terminal is formed to surround the signal terminal.

10. The electronic device of claim 9, wherein the connection member comprises:

a coupling portion fixed to the circuit board and coupled to the signal terminal; and a switch portion connected to a signal line of the circuit board and selectively connected with the coupling portion.

11. The electronic device of claim 10, wherein the switch portion opens and closes connection between the coupling portion and the signal line of the circuit board according to the coupling of the second connector.

12. The electronic device of claim 11, wherein the signal terminal is connected to the signal line of the circuit board via the coupling portion and the switch portion as the signal terminal is coupled to the coupling portion.

13. The electronic device of claim 12, wherein, as the second connector is coupled to the first connector, a signal pin of the second connector separates the switch portion from the coupling portion by passing through the first connector.

14. The electronic device of claim 13, wherein as the second connector is coupled to the first connector, a ground terminal of the second connector is connected to the ground terminal of the first connector.

15. The electronic device of claim 13, further comprising a cable connected to the first connector.

16. The electronic device of claim 15, wherein the second connector comprises an avoidance groove that at least partially receives the cable when being coupled to the first connector.

17. An electronic device comprising:

a connection member mounted on a circuit board; and a first connector coupled to the connection member, wherein a signal terminal of the first connector is electrically connected to the circuit board through the connection member, and a ground terminal of the first connector is connected to a ground of the circuit board, wherein the connection member comprises a coupling portion fixed to the circuit board and a switch portion that is connected to a signal line of the circuit board and selectively connected with the coupling portion, and wherein the ground terminal is formed to surround the signal terminal, and the signal terminal is coupled to enclose the coupling portion.

18. The electronic device of claim 17, wherein the first connector is coupled to the connection member to form a coaxial connector.

19. The electronic device of claim 18, wherein as the second connector, which is coupled to the first connector coupled to the connection member, is connected to the switch portion, the switch portion is separated from the coupling portion.

* * * * *